United States Patent [19]

Snyder, Jr. et al.

[11] 4,097,388

[45] * Jun. 27, 1978

[54] LINEAR FLUORINATED POLYETHER LUBRICANT COMPOSITIONS CONTAINING PERFLUOROALKYLETHER SUBSTITUTED PHOSPHINES

[75] Inventors: Carl E. Snyder, Jr., Trotwood; Christ Tamborski, Dayton, both of Ohio

[73] Assignee: The United States of America as represented by the Secretary of the Air Force, Washington, D.C.

[ * ] Notice: The portion of the term of this patent subsequent to Mar. 8, 1993, has been disclaimed.

[21] Appl. No.: 731,483

[22] Filed: Oct. 12, 1976

[51] Int. Cl.[2] ..... C10M 1/10

[52] U.S. Cl. ..... 252/49.9

[58] Field of Search ..... 252/49.9

[56] References Cited

U.S. PATENT DOCUMENTS

| | | | |
|---|---|---|---|
| 3,201,445 | 8/1965 | Drysdale et al. | 252/49.9 X |
| 3,306,855 | 2/1967 | Borecki | 252/49.9 |
| 3,481,872 | 12/1969 | Dolle et al. | 252/49.9 |
| 3,483,129 | 12/1969 | Dolle et al. | 252/49.9 |
| 3,567,802 | 3/1971 | Garth | 252/49.9 X |
| 4,011,267 | 3/1977 | Tamborski et al. | 252/49.9 X |
| 4,043,926 | 8/1977 | Snyder et al. | 252/49.9 |

*Primary Examiner*—Delbert E. Gantz
*Assistant Examiner*—Andrew H. Metz
*Attorney, Agent, or Firm*—Joseph E. Rusz; Cedric H. Kuhn

[57] ABSTRACT

A lubricant composition comprising (1) a base fluid having the following formula:

$$R_fO(CF_2CF_2O)_m(CF_2O)_nR_f,$$

wherein $R_f$ is a perfluoroalkyl group, $m$ and $n$ are integers whose sum is between 2 and 200 and the ratio of $n$ to $m$ is between 0.1 and 10; and (2) a minor amount of a perfluoroalkylether substituted aryl phosphine.

9 Claims, 1 Drawing Figure

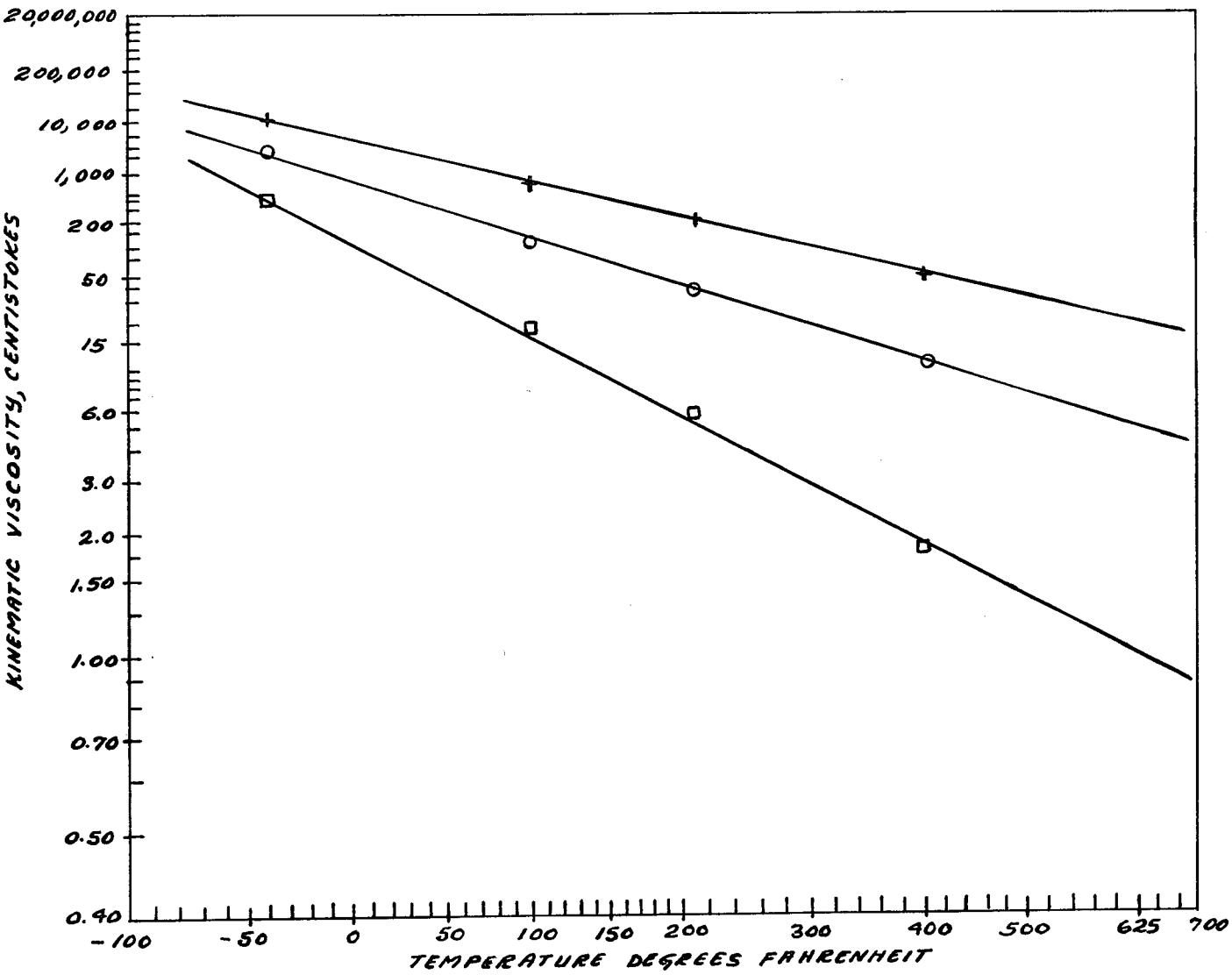
KINEMATIC VISCOSITY, CENTISTOKES
20,000,000
200,000
10,000
1,000
200
50
15
6.0
3.0
2.0
1.50
1.00
0.70
0.50
0.40
-100
-50
0
50
100
150
200
300
400
500
625
700
TEMPERATURE DEGREES FAHRENHEIT

LINEAR FLUORINATED POLYETHER LUBRICANT COMPOSITIONS CONTAINING PERFLUOROALKYLETHER SUBSTITUTED PHOSPHINES

RIGHTS OF THE GOVERNMENT

The invention described herein may be manufactured and used by or for the Government of the United States for all governmental purposes without the payment of any royalty.

BACKGROUND OF THE INVENTION

Because of their thermal stability, perfluorinated polyalkylether fluids have a great potential for use as engine oils, hydraulic fluids and greases. However, a serious drawback in their use results from the fact that certain metals, e.g., certain ones present in aircraft engine components, are corroded at elevated temperatures in an oxidative environment. For example, when the fluids are utilized as lubricants for mechanical components composed of mild steels, serious corrosion has occurred at temperatures of from 550° to 600° F. Furthermore, stainless steels, titanium and titanium alloys are attacked by the fluids at a temperature of about 600° F. Moreover, when used with titanium and titanium alloys, the fluids themselves undergo negative viscosity changes to the detriment of continued lubricating capacity.

An ideal lubricant composition would be one having a relatively constant viscosity such that it is flowable or pumpable over a wide temperature range, e.g., from −50° F to 600° F. Up to the present time, a base fluid fulfilling this requirement has not been available. For example, base fluids having a satisfactory viscosity at low temperatures may degrade at elevated temperatures. And base fluids which are stable and have a satisfactory viscosity at elevated temperatures may be too viscous to flow or pump at sub-zero temperatures. As a result, it has been necessary to make compromises in the selection of base fluids dependent upon the use conditions to be encountered. Such a procedure has not proven to be entirely satisfactory.

In U.S. Pat. No. 3,393,151, issued to one of us as a coinventor on July 16, 1968, lubricants are disclosed that comprise a perfluorinated aliphatic polyether and a perfluorophenyl phosphorus compound. In U.S. Pat. No. 3,499,041, issued to one of us on Mar. 3, 1970, certain perfluoroarylphosphines are disclosed as being anti-corrosion additives for perfluorinated fluids. While the phosphorus compounds described in these patents exhibit corrosion inhibiting properties, at low temperatures they are only poorly soluble in perfluorinated fluids. Also, certain members of the classes of phosphorus compounds possess high volatility characteristics for long term high temperature applications. Because of these limitations, perfluorinated fluids containing such anti-corrosion additives are not completely satisfactory for use in long term, wide temperature range applications.

It is an object of this invention, therefore, to provide a lubricant composition which has little if any corrosive effect upon ferrous and titanium alloys.

Another object of the invention is to provide a lubricant composition which has a relatively constant viscosity over a wide temperature range.

A further object of the invention is to provide a lubricant composition which undergoes substantially no degradation when exposed to titanium.

Other objects and advantages of the invention will be apparent to those skilled in the art upon consideration of the accompanying disclosure and the drawing which shows graphically the viscosity-temperature relationship of base fluids used in the lubricant composition of this invention.

SUMMARY OF THE INVENTION

The present invention resides in a lubricant composition comprising (1) a base fluid consisting essentially of a mixture of linear fluorinated polyethers having the following formula:

$$R_fO(CF_2CF_2O)_m(CF_2O)_nR_f,$$

wherein $R_f$ is $CF_3$ or $C_2F_5$, $m$ and $n$ are integers whose sum is between 2 and 200 and the ratio of $n$ to $m$ is between 0.1 and 10; and (2) a corrosion-inhibiting amount of a perfluoroalkylether substituted aryl phosphine (fluorinated phosphine) having the following formula:

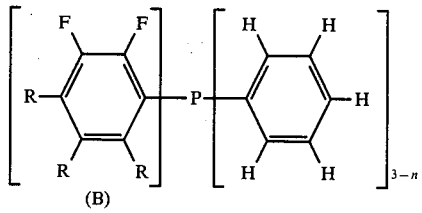

(B)

wherein one of the R's is a perfluoroalkylether group ($CF_2R_fOR_f$), two of the R's are fluorine, and $n$ is 1, 2 or 3.

The base fluids (formula A) are synthesized by initially preparing linear perfluorinated copolyethers by photochemical reaction with molecular oxygen of a liquid phase consisting of a solution of perfluoroethylene in an inert solvent. Elimination of the peroxidic groups of the copolyethers by thermal treatment at a temperature ranging from 100° to 250° C provides the base fluids used in the lubricant composition of this invention.

The $(CF_2CF_2O)_m$ and the $(CF_2O)_n$ groups of the fluorinated polyethers are randomly distributed in the polyether molecules which have $CF_3$ or $C_2F_5$ end groups. The molecules may also contain a small number, e.g., about 1 to 2 percent of the $(CF_2CF_2O)_m$ and $(CF_2O)_n$ groups, of $(CF_2)_3O$ and $(CF_2)_4O$ groups. As mentioned above, $m$ and $n$ are integers whose sum is between 2 and 200. The integers $m$ and $n$ can also be defined as having values such that the fluorinated polyethers have a kinematic viscosity ranging from about 15 to 1000 centistokes at 100° F as determined by the method of ASTM D445. The fluorinated polyethers are normally obtained as mixtures of different molecules, each of which has a well defined molecular weight. The usual practice is to fractionate the fluorinated polyethers so as to obtain a product having a desired average molecular weight or kinematic viscosity as defined hereinabove. For a more complete discussion of the fluorinated polyethers and the process for their production reference may be made to U.S. Pat. No. 3,715,378, issued to D. Sianesi et al. on Feb. 6, 1973, and to D. Dianesi et al., La Chimica E L'Industria, 55, 202–221 (1973).

The preferred fluorinated phosphines (formula B) are those in which the perfluoroalkylether group is para to the phosphorus atom. In general, R can be any perfluoroalkylether group as long as the group contains at least one ether linkage. However, it is often preferred that the group contain two or more ether linkages. Examples of perfluoroalkylether groups include the following where R equals ($CF_2R_fOR_f$) and may be:

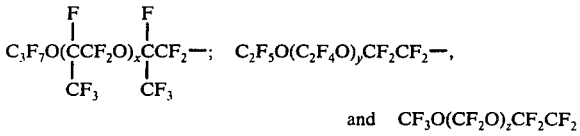

where $x$, $y$ and $z$ are zero or an integer from 1 to 20, inclusive, preferably an integer from 1 to 4, inclusive.

The procedure followed in preparing completely fluorinated phosphines, i.e., when $n$ in the above formula equals 3, can be represented by the following equations:

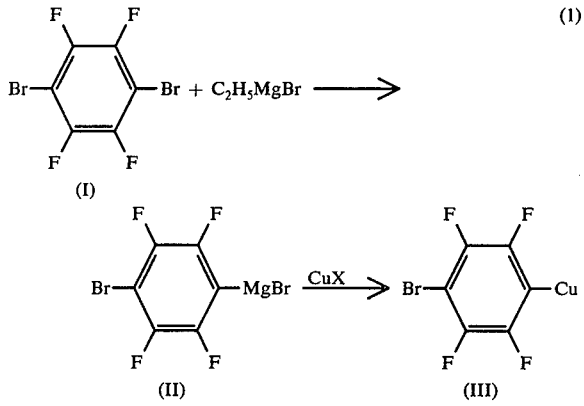

(1)

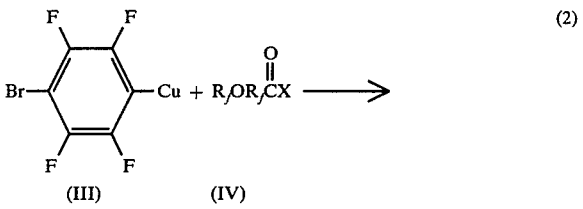

(2)

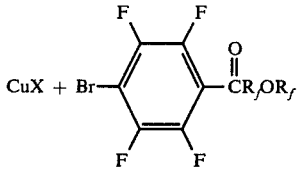

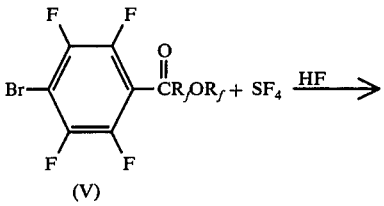

(3)

-continued

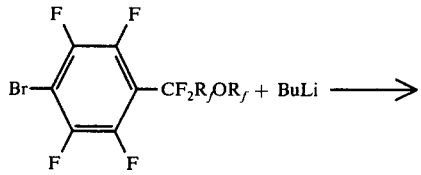

(4)

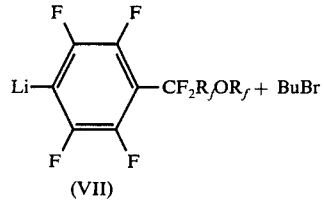

(5)

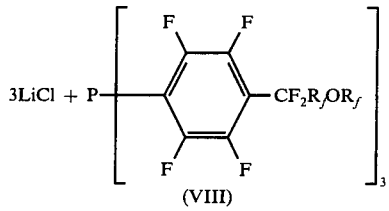

As seen from equation (1), 1,4-dibromotetrafluorobenzene is reacted with ethylmagnesium bromide. The reaction is carried out by mixing solutions of the compounds in suitable solvents under conditions such as to form compounds (II), e.g., at about −5° to 5° C for about 15 minutes to 1 hour. Thereafter, a cuprous chloride, bromide or iodide is added to the reaction mixture whose temperature is allowed to rise to room temperature. The cuprous halide reacts with compound (II), thereby forming organocopper compound (III).

The organocopper compound (III) is an intermediate which can react with perfluoroacyl halides to yield a variety of ketones. The reaction that occurs is shown by equation (2). In carrying out the indicated reaction, the perfluoroacyl halide (IV) is added to organocopper compound (III) which has been cooled to about −5° to 5° C. The compounds are usually allowed to react at room temperature for a period of about 12 to 14 hours after which the reaction mixture is hydrolyzed. After extracting the mixture with a solvent for the ketone product (V), the solvent layer is phase separated and dried. The ketone is then recovered by fractional distillation.

As shown by equation (3), the ketone is fluorinated by reacting same with sulfur tetrafluoride. The reaction is accomplished by adding anhydrous hydrogen fluoride and sulfur tetrafluoride to a cooled pressure vessel containing the ketone. The sealed pressure vessel is then rocked and maintained at a temperature ranging from about 150° to 200° C for a period of about 12 to 24 hours. After cooling and venting the vessel, its contents are washed with a solvent. The solvent is then evaporated, and the residue is fractionally distilled to yield fluorinated product (VI).

In accordance with equation (4), butyllithium is added to a solution of perfluoroalkylether compound (VI) at −70° to −80° C. In the reaction that ensues, which generally takes from 15 minutes to 1 hour, the bromine atom of compound (VI) is replaced with a lithium atom, thereby forming perfluorinated compound (VII). At the end of the reaction period, a solution of phosphorus trichloride is added to compound (VII), and the reaction that occurs yields a phosphine compound (VIII) of this invention. In the reaction as depicted by equation (5), the reaction mixture is stirred at about −70° to −80° C for about 0.5 to 1.5 hours after which it is allowed to warm slowly to about −25° to −35° C over a period of about 3 to 10 hours. Recovery of the product is accomplished by adding dilute hydrochloric acid to the reaction mixture which is phase separated. The bottom viscous layer is washed with water, diluted with a fluorinated solvent and then dried. After filtration and removal of solvent, phosphine product (VIII) is obtained by fractional distillation in the form of a viscous liquid.

The materials used in preparing the intermediates and the phosphine products are known compounds that are described in the literature. The foregoing equations illustrate the preparation of para substituted compounds. However, it is also within the scope of the invention to use the meta and ortho isomers as anti-corrosion additives in the lubricant composition. In synthesizing the meta and ortho isomers, 1,3- and 1,2-dibromotetrafluorobenzene, respectively, are utilized as a starting material rather than 1,4-dibromotetrafluorobenzene.

Any acyl halide can be used that corresponds to the formula $R_fOR_fC(O)X$, where $R_fOR_f$ is a perfluoroalkylether group and X is a halogen. Examples of suitable acyl halides, which are a source of the $R_fOR_f$ groups, are disclosed in U.S. Pat. Nos. 3,124,599, 3,214,478 and 3,721,696. Thus, depending upon the acyl halide employed, a variety of ketones can be synthesized according to the reaction illustrated by equation (2). As shown by equation (3), the ketone is fluorinated with sulfur tetrafluoride so that its ketone group becomes a $CF_2$ group. Thus, in the above formula defining the fluorinated phosphines as corrosion inhibitors in the lubricant compositions of this invention, R equals $CF_2R_fOR_f$ where this group appears in the foregoing equations.

The foregoing description has been concerned with completely fluorinated phosphines. However, it is within the purview of the present invention to use as the anti-corrosion additives partially fluorinated phosphines, i.e., where $n$ in the above formula is 1 or 2. The same procedure as described above is followed in preparing the partially fluorinated phosphines except that in the reaction illustrated by equation (5) phenyldichlorophosphine ($n=2$) or diphenylchlorophosphine ($n=1$) is reacted with compound (VII) instead of phosphorus trichloride. The reaction involved can be represented by the following equation:

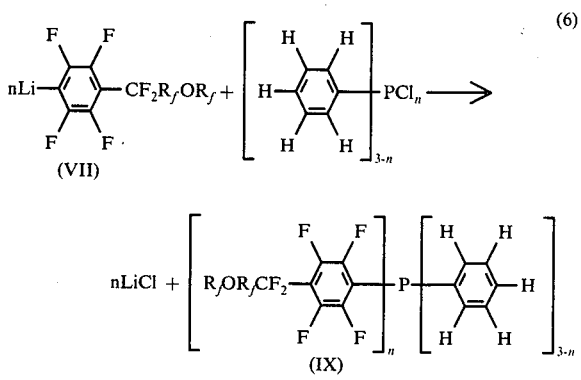

In equation (6), $n$ equals 1 or 2.

A more detailed description of the synthesis of the fluorinated phosphines is contained in our copending application Ser. No. 629,469, filed on Nov. 6, 1975 and now issued as U.S. Pat. No. 4,011,267. The disclosure of that application is incorporated herein by reference.

In formulating the lubricant of this invention, a corrosion-inhibiting amount of the phosphine compound is mixed with the linear fluorinated polyether base fluid. The amount of the phosphine compound used generally ranges from 0.05 to 5 weight percent, preferably 0.5 to 2 weight percent, based upon the weight of the base fluid.

The present invention provides a lubricant composition which is not subject to the disadvantages of the prior art lubricants. The outstanding properties of the lubricant can be attributed not only to the particular base fluid and the phosphine additive used but also to the unexpected effect obtained by mixing the two components. Importantly, the phosphine anti-corrosion additives are soluble at low temperatures in the base fluid and are substantially non-volatile at elevated temperatures. As a result, there is provided a lubricant containing an amount of anti-corrosion additive that is adequate for long term applications at elevated temperatures while still maintaining excellent formulation stability after storage at low temperatures for long periods of time.

Of equal importance, the base fluid possesses a relatively constant viscosity over a wide temperature range. In the drawing there is illustrated graphically the variation in kinematic viscosity over a wide temperature range of three different base fluids as disclosed herein. The data were obtained in accordance with the method of ASTM D445. From an examination of the graphs, it is seen that the change in kinematic viscosity is relatively small over a wide temperature range. As a result, the base fluids under the test conditions are flowable or pumpable over the temperature range. However, it has also been found that the base fluid per se degrades rapidly under use conditions at elevated temperatures. Surprisingly, it was discovered that the phosphine additive functions to oxidatively stabilize the base fluid at elevated temperatures without affecting its desirable viscosity characteristics. Thus, the lubricant composition of this invention in addition to its other desirable properties has a relatively constant viscosity such that it is flowable or pumpable over a wide temperature range.

A more complete understanding of the invention can be obtained by referring to the following illustrative examples which are not intended, however, to be unduly limitative of the invention.

EXAMPLE I

A series of runs was conducted for the purpose of determining the effectiveness of lubricant compositions of this invention. Lubricant compositions were formulated by mixing (1) a base fluid having the following formula:

$$R_fO(CF_2CF_2O)_m(CF_2O)_nR_f$$

where $R_f$ is $CF_3$ or $C_2F_5$, $m$ and $n$ are integers having values such that the fluid has a kinematic viscosity of about 17.8 centistokes at 100° F with (2) various weight percentages, based upon the weight of the base fluid, of a fluorinated phosphine having the following formula:

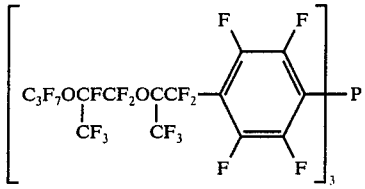

The base fluid used was Fomblin Z fluid, a product of Montedison, S.p.A., Milan, Italy.

In the runs a specimen of steel, titanium alloy or titanium was immersed in the formulations that were prepared. The compositions of the steel and titanium alloys are described in the literature. For comparison purposes, runs were also carried out in which specimens were immersed in polyether fluid which did not contain the anti-corrosion additive. The materials were contained in an oxidation test tube having a take-off adapter coupled to an air entry tube. An aluminum block bath provided the means for heating the test tube and an "overboard" test procedure (no reflux condenser) was followed.

Air was bubbled through the formulations, or in the case of the control test through the polyether fluid, at the rate of one liter of air per hour for a period of 24 hours. The runs were conducted at a constant temperature of 550° F. The specimens as well as the apparatus used were weighed prior to and after completion of each run.

The data obtained in the runs are set forth below in the tables.

TABLE I

| Wt % Additive | Kinematic Viscosity Change at 100° F % | Fluid Loss Wt % | 4140 Steel | Weight Change, mg/cm² 52100 Bearing Steel | 410 Stainless Steel | M-50 Tool Steel | 440C Stainless Steel |
|---|---|---|---|---|---|---|---|
| | | | 550° F | | | | |
| None | (1) | 83.75 | +0.024 | +0.48 | −5.54 | −2.37 | −3.10 |
| 0.5 | +3.99 | 0.57 | −0.87 | +0.51 | +0.01 | +0.68 | +0.12 |
| 1.0 | +0.22 | 0.31 | +0.042 | +0.031 | +0.05 | +0.01 | 0.00 |
| 2.0 | +0.85 | 0.69 | +1.22 | +0.84 | +0.13 | +1.02 | +0.16 |
| | | | 600° F | | | | |
| None | (1) | 100 | −3.54 | +1.60 | −8.58 | +0.60 | −9.89 |
| 0.5 | 0.0 | 0.53 | −3.61 | +1.38 | −0.01 | +2.25 | −0.01 |
| 1.0 | +0.1 | 0.25 | +1.43 | +0.41 | −0.35 | +0.44 | −0.02 |
| 2.0 | −0.22 | 0.45 | +4.65 | +0.46 | 0.00 | +2.74 | +0.01 |

(1) Insufficient fluid to measure.

TABLE II

| Temp, ° F | Wt % Additive | Kinematic Viscosity Change at 100° F, % | Fluid Loss Wt % | Weight Change, mg/cm² Ti(6A14V) | Ti(pure) | Ti(4A14Mn) |
|---|---|---|---|---|---|---|
| 550 | None | −97.22 | 59.87 | +0.06 | −0.28 | −0.28 |
| 550 | 0.5 | +3.87 | 0.57 | +0.06 | 0.00 | +0.03 |
| 550 | 1.0 | +0.16 | 0.10 | +0.01 | +0.01 | +0.01 |
| 550 | 2.0 | +0.39 | 0.17 | +0.07 | +0.05 | +0.10 |

EXAMPLE II

Runs are carried out in which lubricant compositions are tested by the same procedure described in Example I. The lubricant compositions are formulated by mixing the same base fluid used in Example I with various weight percentages of several fluorinated phosphine additives. The following fluorinated phosphines are used in formulating the lubricants:

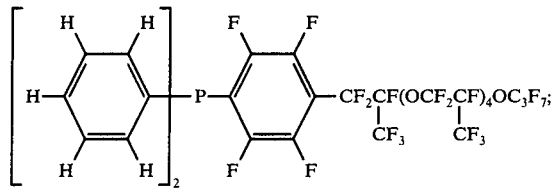

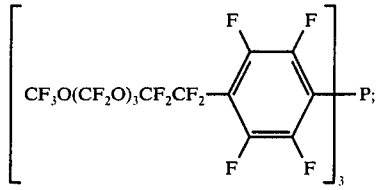

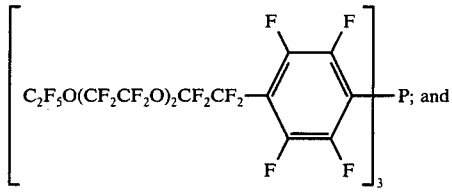

-continued

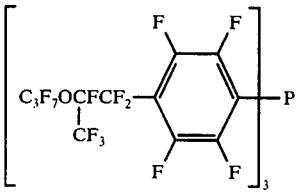

The data obtained in the runs are substantially the same as the data obtained in the runs of Example I.

The data in the foregoing tables show that the lubricant compositions of the invention have little if any corrosive effect upon titanium and ferrous and titanium alloys. Also, there was substantially no degradation of the lubricant compositions at the elevated temperatures even though the base fluid per se was severely degraded. It is thus seen that the phosphine additives function both as an anti-corrosion and an anti-oxidation agent. Because of their outstanding properties, the lubricants can be used in applications requiring extreme temperature conditions. Examples of uses for the lubricants include gas turbine engine lubricants, nonflammable hydraulic fluids, greases compatible with liquid oxygen, and liquid coolants and general purpose lubricants.

As will be evident to those skilled in the art, modifications of the present invention can be made in view of the foregoing disclosure without departing from the spirit and scope of the invention.

We claim:

1. A lubricant composition comprising (1) a base fluid consisting essentially of a mixture of linear fluorinated polyethers having the following formula:

$$R_fO(CF_2CF_2O)_m(CF_2O)_nR_f,$$

wherein $R_f$ is $CF_3$ or $C_2F_5$, $m$ and $n$ are integers whose sum is between 2 and 200 and the ratio of $n$ to $m$ is between 0.1 and 10; and (2) a corrosion-inhibiting amount of a perfluoroalkylether substituted aryl phosphine having the following formula:

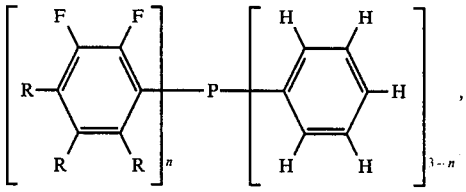

wherein one of the R's is a perfluoroalkylether group, two of the R's are fluorine, and $n$ is 1, 2 or 3.

2. The lubricant composition according to claim 1 in which the amount of the phosphine ranges from about 0.05 to 5 weight percent, based upon the weight of the base fluid.

3. The lubricant composition according to claim 1 in which the amount of the phosphine ranges from about 0.5 to 2.0 weight percent based upon the weight of the base fluid.

4. The lubricant composition according to claim 1 in which one of the R's of the phosphine is

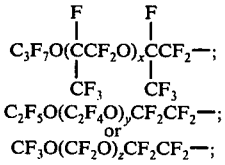

where $x$, $y$ and $z$ are zero or an integer from 1 to 20, inclusive.

5. The lubricant composition according to claim 4 in which the phosphine has the following formula:

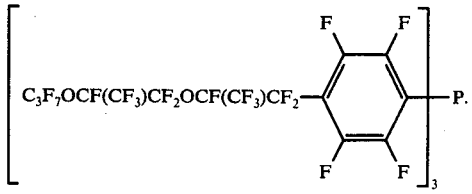

6. The composition according to claim 4 in which the phosphine has the following formula:

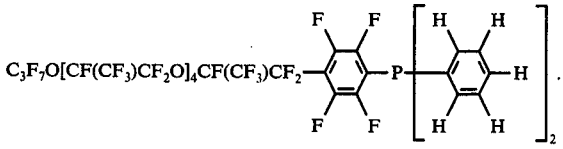

7. The lubricant composition according to claim 4 in which phosphine has the following formula:

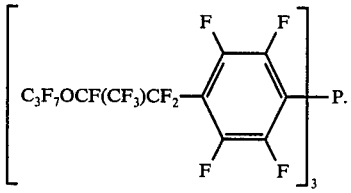

8. The lubricant composition according to claim 4 in which the phosphine has the following formula:

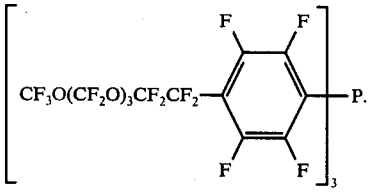

9. The lubricant composition according to claim 4 in which the phosphine has the following formula:

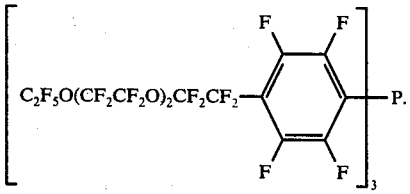

* * * * *

UNITED STATES PATENT AND TRADEMARK OFFICE

CERTIFICATE OF CORRECTION

PATENT NO. : 4,097,388

DATED : June 27, 1978

INVENTOR(S) : Carl E. Snyder, Jr. and Christ Tamborski

It is certified that error appears in the above–identified patent and that said Letters Patent are hereby corrected as shown below:

Col. 2, lines 25 to 30, the formula should read as follows:

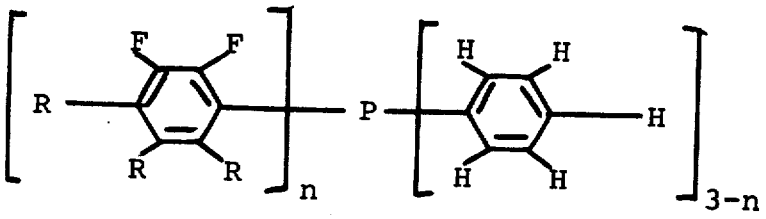

Signed and Sealed this

Fifth Day of December 1978

[SEAL]

*Attest:*

RUTH C. MASON
*Attesting Officer*

DONALD W. BANNER
*Commissioner of Patents and Trademarks*